US006296158B1

(12) United States Patent
Zhou et al.

(10) Patent No.: US 6,296,158 B1
(45) Date of Patent: Oct. 2, 2001

(54) DISPOSABLE SPOUT FOR CANS

(76) Inventors: Lin Zhou, 11830 SW. 104 La., Miami, FL (US) 33186; Cheng Shan Yin, 9375 Fountainbleau Blvd., #L415, Miami, FL (US) 33172

( * ) Notice: Subject to any disclaimer, the term of this patent is extended or adjusted under 35 U.S.C. 154(b) by 0 days.

(21) Appl. No.: 09/452,856

(22) Filed: Dec. 3, 1999

(51) Int. Cl.[7] ..... B65D 5/72
(52) U.S. Cl. ..... 222/570
(58) Field of Search ..... 272/570; D9/447

(56) References Cited

U.S. PATENT DOCUMENTS

| | | | | |
|---|---|---|---|---|
| D. 269,596 | | 7/1983 | Fowkes | D9/447 |
| 1,952,288 | | 3/1934 | Saxon | 221/23 |
| 2,802,609 | * | 8/1957 | Donovan | 222/570 |
| 2,873,881 | * | 2/1959 | Nichols | 222/570 |
| 3,252,635 | * | 5/1966 | Rosenhan | 222/570 |
| 3,272,395 | * | 9/1966 | Lawyer | 222/570 |
| 5,137,188 | * | 8/1992 | Thompson | 222/570 |
| 5,213,239 | * | 5/1993 | Macaluso | 222/570 |

FOREIGN PATENT DOCUMENTS

| | | | | |
|---|---|---|---|---|
| 865259 | * | 4/1961 | (GB) | 222/570 |

* cited by examiner

*Primary Examiner*—Philippe Derakshani
(74) *Attorney, Agent, or Firm*—J. Sanchelima

(57) ABSTRACT

A flexible disposable spout removably mounted to the inwardly extending flanges found in certain types of cans, particularly paint cans, to ensure that its contents are properly poured out and no contact is made with the can itself. The spout has a cylindrical or frustoconical shape with two ends. At least one of the ends has two parallel and peripherally extending ridge members that are kept at a predetermined spaced apart relationship with respect to each other to cooperatively engage with the inwardly extending flange defining the can opening. The other end may be designed to also accept the same type of inward flange for an opening of a different size typically associated with a can of a different capacity or the same capacity with different opening dimensions. Thus the spout's cylindrical portion has a frustoconical shape. The peripheral ridge member farthest from the end is larger in longitudinal height than the one adjacent to the end so that it acts as a stopper against the inwardly extending flange when spout is pushed through the can's opening. The separation between the ridge members of the distal end, not engaged to the can, block the running of any residual paint down the spout.

5 Claims, 2 Drawing Sheets

DISPOSABLE SPOUT FOR CANS

BACKGROUND OF THE INVENTION

1. Field of the Invention

The present invention relates to a disposable spout for cans, and more particularly, to a disposable spout for cans intended to prevent paint spills.

2. Description of the Related Art

When liquids and powders are placed in can containers and are manipulated by users, it is common for spillage to occur resulting in damage to surrounding areas and/or objects. Additionally, many of these spills, or even when a user soaks a paint brush in a paint can and removes the excess paint, it causes the clogging of the peripheral channel or groove typically found in cans. Thus, the closure mechanism deteriorates and the result is that unwanted air is introduced inside the can. Many other problems can be identified to be related to the undesired escape of liquids and powders from can containers.

The problem of paint spills has propelled the design of numerous container spouts to prevent them. However, none of these spouts solve the problem efficiently. The present invention solves this problem efficiently and economically. The present invention is adapted to be used at both ends, thus enhancing its flexibility and ability to work with two different can openings with different dimensions.

Paint cans typically include inner and outer circular ridges designed to receive a cooperating cover peripheral flange in between. The dimensions of the openings in the different cans existing in the market today vary depending on the capacity of the cans and the manufacturer. There are two main manufacturers in the U.S. market, for example, United States Can Company and Brockway Standard, Inc. with their own unique dimension standards.

Applicant believes that the closest reference corresponds to U.S. Pat. No. 1,952,288 issued to J. R. Saxon. However, it differs from the present invention because the spout not being completely circular, allows for the possibility of spillage. Also, the circular spout has the advantage of providing a more structurally sound spout. The engagement with the inwardly extending flange is not a sturdy one as in the present invention where the peripheral ridges provide structural integrity to the engagement while a secure locking mechanism is obtained.

Another related reference is design patent Des. 269,596 issued to Fowkes. This design patent discloses a circular spout with two separations and only one end is being used. When mounted to the peripheral flange of a can opening, a substantial portion of Fowkes' spout intrudes inside the can and traps a considerable amount of paint. This trapped paint spills over when the spout is removed. Additionally, the spout itself will have residual paint that may run down and find its way into the peripheral channel of the paint can.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a spout that can be readily mounted to the inwardly extending flange defining the can's opening. Also, one of the main advantages of this invention is that the spout can be provided with two ends for removably fitting can openings of different dimensions or configurations.

It is another object of this invention to provide a spout that prevents the contents of the can to come in contact with exterior portions thereof including the outer surface of the can, the closure peripheral ridges, and/or surrounding areas.

It is still another object of the present invention to provide a spout that is disposable.

It is yet another object of this invention to provide such a device that is inexpensive to manufacture and maintain while retaining its effectiveness.

It is another object to provide an inexpensive practical spout with sufficient lateral area to accommodate advertising or promotional displays.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
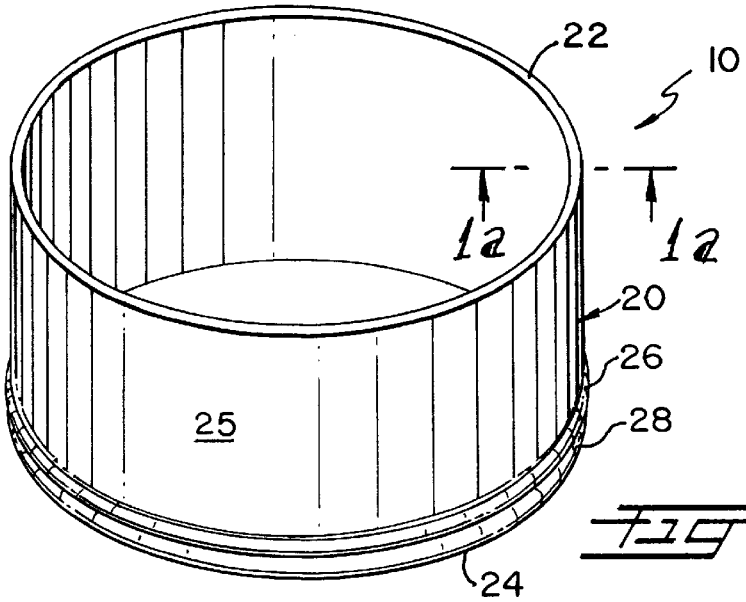
FIG. 1 represents an isometric view of one of the preferred embodiments for the present invention.
Figure 1A:
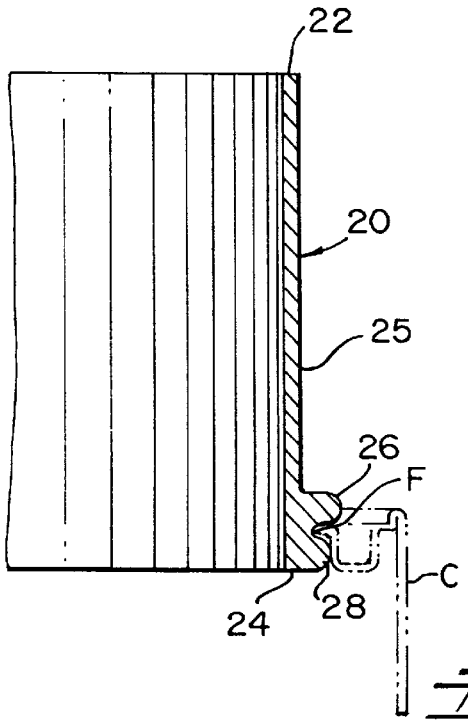
FIG. 1*a* illustrates a partial cross sectional view taken along line 1*a*—1*a* in FIG. 1, and the engagement to a typical can in phantom.

Referring now to the drawings, where the present invention is generally referred to with numeral 10, it can be observed that it basically includes a cylindrical body 20 with two ends 22 and 24. One of the ends, in the preferred embodiment shown in FIG. 1, includes two peripheral ridges 26 and 28 running parallel with respect to each other and spaced apart from each other at a predetermined distance, as seen in FIG. 1. The separation of ridges 26 and 28, as it can be seen in FIG. 1*a,* is such that it cooperates to receive the inwardly extending flange F typically found in can C, such as paint cans. The diameter of end 24 is selected so that it cooperates with the dimensions of the opening of a particular can size. The lateral wall 25 of cylindrical body 20 is such that it can be used to display advertising or other promotional material.

Figure 2:
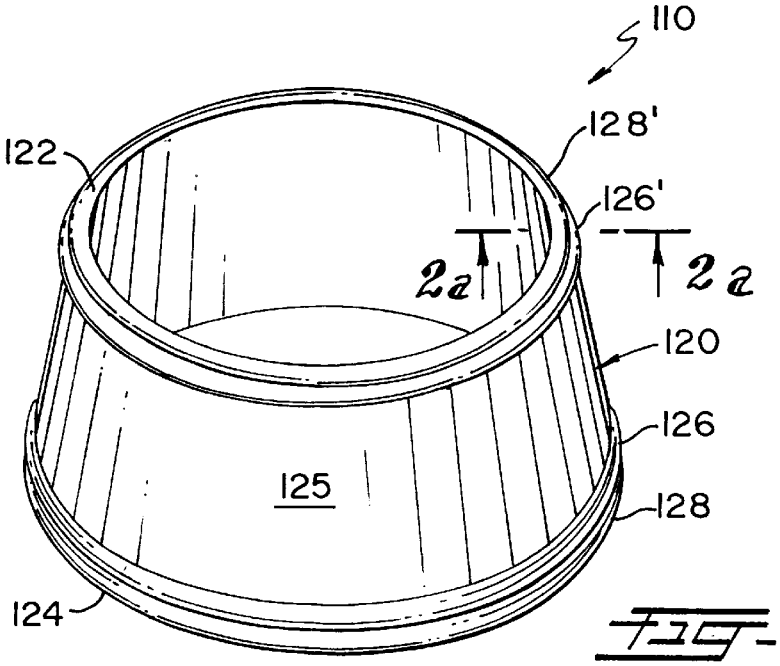
FIG. 2 is an isometric representation of an alternate embodiment for the present invention with two usable ends.
Figure 2A:
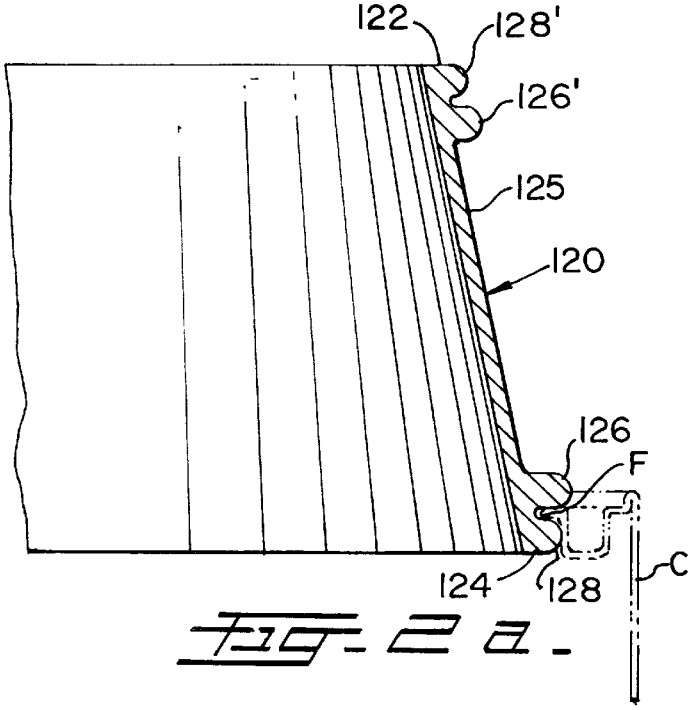
FIG. 2*a* illustrates a partial cross sectional view taken along line 2*a*—2*a* in FIG. 2, and the engagement to a typical can in phantom.

The alternate embodiment shown in FIGS. 2 and 2*a* shows a frustoconical spout 110 with body 120 having ends 122 and 124. End 124 has peripheral ridges 126 and 128. End 122 has peripheral ridges 126' and 128'. This permits a user to utilize one end for cans of a certain opening size and the other end for cans having another opening size. Also, even for cans of the same capacity, the characteristics of the engagement ridges 126 and 128 may be different from those of members 126' and 128' to accommodate standards of different can manufacturers. In this manner the logistics of inventory, production, transportation and storage are simplified.

Another function of ridges 126' and 128', when used in the distal and not engaged end, is to trap residual paint or liquid that attempts to run down the lateral wall 125 of the spout. The residual liquid, such as the one left by a brush when removing the excess paint, travels along the separation between the two ridge members preventing the paint from running down over wall 125.

Body 20 (and 120) is made out of a resilient material that permits the cammingly deflection of the ends as spout 10 (or 110) is pushed through the can opening overcoming ridge member 28 (and 128 or 128') and removably lodging the can's inwardly extending flange F in between members 26 and 28 (126 and 128 or 126' and 128'). This material must be resistant to petroleum-based products and paints. One of such materials envisioned by the Applicant is polyethylene or the like. However, when one of the ends is conformed to the can's opening to define spout, body 120 is sufficiently rigid to channel the liquid away from the can. Member 26 (126 and 126') acts as a stopper against any further movement of spout 10 or 110 through the can opening. The longitudinal height of member 26 (126 and 126') is larger than the longitudinal height of member 28 (128 and 128').

The foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A spout for cans that include an inwardly extending flange and a peripheral channel extending parallel and outwardly spaced apart from said flange, said spout comprising a cylindrical body having first and second ends, said first end including first and second peripheral ridge members extending at a parallel and spaced apart relationship with respect to each other with a first predetermined distance in between to lockingly receive said flange thereby removably mounting said spout to said can wherein said first peripheral ridge member is the closest to said first end, and said second peripheral ridge member having a larger longitudinal height than the longitudinal height of said first peripheral ridge member so that when said first end is pushed through said can opening said inwardly extending flange cammingly deflects said first peripheral ridge member and once overcome said flange is removably lodged between said first and second peripheral ridge members and stopped by said second peripheral ridge member wherein said second end includes third and fourth peripheral ridge members extending at a parallel and spaced apart relationship with respect to each other with a second predetermined distance in between to lockingly receive said inner ridge thereby removably mounting said spout to said can, said third peripheral ridge member being closer to said second end than said fourth peripheral member.

2. The spout set forth in claim 1 wherein the diameter of said first end is different from the diameter of said second end so that can openings of different dimensions can be engaged with each of said ends.

3. The spout set forth in claim 2 wherein said fourth peripheral ridge member has a larger longitudinal height than the longitudinal height of said third peripheral ridge member so that when said second end is pushed through said can opening said inwardly extending flange cammingly deflects said third peripheral ridge member and once overcome said flange is removably lodged between said third and fourth peripheral ridge members and stopped by said fourth peripheral ridge member.

4. A spout for cans that include an inwardly extending flange and a peripheral channel extending parallel and outwardly spaced apart from said flange, said spout comprising a frustoconical body having first and second ends with different diameters said first end including fast and second peripheral ridge members extending at a parallel and spaced apart relationship with respect to each other with a first predetermined distance in between to lockingly receive said flange thereby removably mounting said spout to said can, and wherein said first peripheral ridge member is the closest to said first end, and said second peripheral ridge member having a larger longitudinal height than the longitudinal height of said first peripheral ridge member so that when said first end is pushed through said can opening said inwardly extending flange cammingly deflects said first peripheral ridge member and once overcome said flange is removably lodged between said first and second peripheral ridge members and stopped by said second peripheral ridge member and wherein said second end includes third and fourth peripheral ridge members extending at a parallel and spaced apart relationship with respect to each other with a second predetermined distance in between to lockingly receive said inner ridge thereby removably mounting said spout to said can, said third peripheral ridge member being closer to said second end than said fourth peripheral member so that cans with openings of different dimensions can be engaged with each of said ends.

5. The spout set forth in claim 4 wherein said fourth peripheral ridge member has a larger longitudinal height than the longitudinal height of said third peripheral ridge member so that when said second end is pushed through said can opening said inwardly extending flange cammingly deflects said third peripheral ridge member and once overcome said flange is removably lodged between said third and fourth peripheral ridge members and stopped by said fourth peripheral ridge member.

* * * * *